US010650633B2

(12) United States Patent
Yamaguchi et al.

(10) Patent No.: US 10,650,633 B2
(45) Date of Patent: May 12, 2020

(54) GAME CONTROLLER

(71) Applicant: Universal Entertainment Corporation, Koto-Ku, Tokyo (JP)

(72) Inventors: Shinsuke Yamaguchi, Tokyo (JP); Kouichi Matsumoto, Tokyo (JP); Yoshiyuki Kanno, Tokyo (JP); Masaya Kato, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 0 days.

(21) Appl. No.: 16/107,428

(22) Filed: Aug. 21, 2018

(65) Prior Publication Data

US 2019/0066438 A1 Feb. 28, 2019

(30) Foreign Application Priority Data

Aug. 24, 2017 (JP) ..... 2017-161104

(51) Int. Cl.
*G07F 17/00* (2006.01)
*G07F 17/32* (2006.01)

(52) U.S. Cl.
CPC ..... *G07F 17/3223* (2013.01); *G07F 17/322* (2013.01); *G07F 17/3227* (2013.01)

(58) Field of Classification Search
None
See application file for complete search history.

(56) References Cited

U.S. PATENT DOCUMENTS 7,725,403 B2 * 5/2010 Boyd ..... G06Q 20/02 705/64
8,961,296 B2 * 2/2015 Walker ..... G07F 1/06 463/21
9,536,388 B2 * 1/2017 Panambur ..... G07F 17/3248
2008/0113767 A1 * 5/2008 Nguyen ..... G07F 17/32 463/25
2008/0234052 A1 * 9/2008 Steil ..... G07F 1/06 463/47
2013/0320212 A1 * 12/2013 Valentino ..... G01J 1/0488 250/336.1
2017/0018140 A1 1/2017 Yamaguchi et al.

FOREIGN PATENT DOCUMENTS

JP 2015139611 A 8/2015

* cited by examiner

*Primary Examiner* — Paul A D'Agostino
(74) *Attorney, Agent, or Firm* — Potomac Law Group, PLLC; Kenneth Fagin

(57) ABSTRACT

A game controller downloads a chip database at a predetermined timing from a server and stores the chip database as offline data in a storage unit, determines whether communication with the server is possible, when a chip communication unit accesses a game chip, and authenticates the game chip with reference to a offline data table when the communication is impossible.

5 Claims, 10 Drawing Sheets

FIG.3

GAME INFORMATION TABLE

| TABLE ID | DEALER ID | GAME ID | GAME RESULT | PARTICIPANT ID | SEAT ID | BET OBJECT | BET AMOUNT | PAYOUT | COMMISSION | SERVER |
|---|---|---|---|---|---|---|---|---|---|---|
| ... | ... | ... | ... | ... | ... | ... | ... | ... | ... | ... |
| 0123 | 28910105 | 0056 | BANKER | 00035475 | 01 | BANKER | 100 | 100 | 5 | TRUE |
| 0123 | 28910105 | 0056 | BANKER | 00165975 | 02 | TIE | 5 | 0 | 0 | TRUE |
| 0123 | 28910105 | 0056 | BANKER | 00165975 | 02 | PLAYER | 20 | 0 | 0 | TRUE |
| 0123 | 28910105 | 0056 | BANKER | 01359742 | 04 | BANKER | 200 | 200 | 10 | TRUE |
| 0123 | 28910105 | 0057 | PLAYER | 00035475 | 01 | BANKER | 50 | 0 | 0 | FLASE |
| 0123 | 28910105 | 0057 | PLAYER | 00165975 | 02 | PLAYER | 20 | 20 | 0 | FLASE |
| 0123 | 28910105 | 0057 | PLAYER | 01359742 | 04 | PLAYER | 100 | 0 | 0 | FLASE |
| ... | ... | ... | ... | ... | ... | ... | ... | ... | ... | ... |

FIG.4

DEAL INFORMATION TABLE

| TABLE ID | DEALER ID | GAME ID | PARTICIPANT ID | CHIP ID | CHIP AMOUNT | OWNER BEFORE GAME | OWNER AFTER GAME | SERVER |
|---|---|---|---|---|---|---|---|---|
| ... | ... | ... | ... | ... | ... | ... | ... | ... |
| 0123 | 28910105 | 0056 | 00035475 | 0000752016 | 100 | PARTICIPANT | PARTICIPANT | TRUE |
| 0123 | 28910105 | 0056 | 00035475 | 0057489521 | 5 | PARTICIPANT | GAMING FACILITY | TRUE |
| 0123 | 28910105 | 0056 | 00035475 | 000006639 | 100 | GAMING FACILITY | PARTICIPANT | TRUE |
| 0123 | 28910105 | 0056 | 00165975 | 0006486412 | 5 | PARTICIPANT | GAMING FACILITY | TRUE |
| 0123 | 28910105 | 0056 | 00165975 | 0000469456 | 10 | PARTICIPANT | GAMING FACILITY | TRUE |
| 0123 | 28910105 | 0056 | 00165975 | 0000786511 | 10 | PARTICIPANT | GAMING FACILITY | TRUE |
| ... | ... | ... | ... | ... | ... | ... | ... | ... |
| 0123 | 28910105 | 0057 | 00035475 | 0023485674 | 50 | PARTICIPANT | GAMING FACILITY | FALSE |
| 0123 | 28910105 | 0057 | 00165975 | 0000545791 | 10 | PARTICIPANT | PARTICIPANT | FALSE |
| 0123 | 28910105 | 0057 | 00165975 | 0000025404 | 10 | PARTICIPANT | PARTICIPANT | FALSE |
| 0123 | 28910105 | 0057 | 00165975 | 0001224867 | 10 | GAMING FACILITY | PARTICIPANT | FALSE |
| 0123 | 28910105 | 0057 | 00165975 | 0020001452 | 10 | GAMING FACILITY | PARTICIPANT | FALSE |
| 0123 | 28910105 | 0056 | 01359742 | 0139420015 | 10 | PARTICIPANT | GAMING FACILITY | FALSE |
| ... | ... | ... | ... | ... | ... | ... | ... | ... |

FIG.8

OFFLINE DATA TABLE

| CHIP IDENTIFICATION INFORMATION | BUSINESS SITE IDENTIFICATION INFORMATION | DISPLAY SURFACE AMOUNT | CHIP STATUS INFORMATION | CHIP OWNER | VALID/ INVALID STATUS | LATEST VALIDATION TIME AND DATE | VALIDATION DEVICE INFORMATION | LATEST INVALIDATION TIME AND DATE | INVALIDATION DEVICE INFORMATION | SERVER |
|---|---|---|---|---|---|---|---|---|---|---|
| ... | ... | ... | ... | ... | ... | ... | ... | ... | ... | ... |
| 0000234181 | 005 | 10 | COLLECTION | 005 | INVALID | 2017/07/27 14:25:52 | 0352 | 2017/07/27 16:26:32 | 0123 | TRUE |
| 001000023 | 005 | 50 | PURCHASE | 02023546 | VALID | 2017/07/27 19:26:23 | 0123 | 2017/07/27 16:26:33 | 0123 | TRUE |
| 000250454 | 005 | 10 | PURCHASE | 00005394 | VALID | 2017/07/27 19:12:26 | 0123 | 2017/07/27 16:12:26 | 0123 | TRUE |
| 014280114 | 005 | 10 | CASH IN | 005 | INVALID | 2017/07/21 13:26:56 | 0123 | 2017/07/22 11:26:26 | 0352 | TRUE |
| 001539745 | 005 | 100 | CASH IN | 005 | INVALID | 2017/07/21 13:26:26 | 0123 | 2017/07/22 11:26:26 | 0352 | FLASE |
| 020125348 | 005 | 50 | PAYOUT | 00041545 | VALID | 2017/07/27 16:26:26 | 0123 | 2017/07/27 16:26:56 | 0123 | FLASE |
| 002410518 | 005 | 100 | PURCHASE | 00002546 | VALID | 2017/07/27 19:26:23 | 0123 | 2017/07/27 16:52:12 | 0123 | FLASE |
| 023451568 | 005 | 100 | PAYOUT | 01023004 | VALID | 2017/07/27 15:25:52 | 0123 | 2017/07/27 14:26:26 | 0123 | FLASE |
| ... | ... | ... | ... | ... | ... | ... | ... | ... | ... | ... |

GAME CONTROLLER

CROSS-REFERENCE TO RELATED APPLICATION

This application claims the benefit of Japanese Pat. App. No. 2017-161104, filed on Aug. 24, 2017 which application is incorporated herein by reference in its entirety.

FIELD OF THE INVENTION

The present invention relates to a game controller configured to authenticate a game chip over a network.

BACKGROUND OF THE INVENTION

In card games and games such as roulette played in gaming facilities, game chips dedicated to each gaming facility are typically used for deals. To be more specific, a player participates in a game by betting a game chip, and a dealer collects the betted game chip, awards a game chip to the player, and so on in accordance with a game result. As such, the game chips function as coins used in gaming facilities, and hence one may try to deceivingly obtain game chips.

In view of the above, the following scheme has been proposed: an RF tag is embedded in a game chip to store identification information, etc., an antenna for reading RF tags is provided on a gaming machine such as a table on which game chips are placed in the deals, and a game chip is authenticated each time the game chip is used in the game (see e.g., Patent Literature 1 (Japanese Unexamined Patent Publication No. 2015-139611)).

BRIEF SUMMARY OF THE INVENTION

Information for authenticating game chips used in gaming facilities is stored in a server communicably connected to the known gaming machine, in association with identification information of each game chip. That is to say, in order to improve the security, each time a game chip is used, the gaming machine typically refers to identification information of the game chip in the server and performs authentication.

However, when the network of the gaming facility is down and a failure occurs in the communication with the server, authentication of game chips cannot be done. On this account, either the game is continued with lowered security or the game is interrupted in order to maintain the security.

An object of the present application is to provide a game controller with which a game is continued without lowering security even in an offline state in which a network is down.

A game controller of the present invention includes: a chip communication unit capable of accessing identification information of a game chip used for a game; a communication connection unit configured to enable data communication with a server including a chip database in which the identification information for identifying the game chip is associated with information used for authenticating the game chip; a storage unit; and a control unit, the control unit downloading the chip database from the server at a predetermined timing and storing the chip database as offline data in the storage unit, determining whether the communication with the server is possible, when the chip communication unit accesses the game chip, and authenticating the game chip with reference to the offline data when the communication is impossible.

According to this arrangement, when the communication with the server is impossible in this manner, authentication of the game chip is performed with reference to the offline data table which includes the same information as the chip database and has been downloaded from the server in advance. This makes it possible to continue the game without lowering the security, even in the offline state in which the network is down.

The game controller of the present invention may further include a deal information acquisition unit capable of acquiring deal information of the game chip between a player who plays the game and a dealer who manages the game, and the control unit determining whether the communication with the server is possible, when the deal information acquisition unit acquires the deal information, sending the deal information to the server when the communication is possible, accumulating the deal information in the storage unit when the communication is impossible, and sending the accumulated deal information to the server after the communication is restored.

According to this arrangement, even if the communication with the server is impossible, the deal information can be locally stored. Return to the normal state after the restoration is therefore possible after the progress of the game in the offline state, with the result that loss due to discontinuation of the game is prevented.

The game controller of the present invention may further include a game result acquisition unit capable of acquiring a game result of the game, the control unit determining whether the communication with the server is possible, when the game result acquisition unit acquires the game result, sending the game result to the server when the communication is possible, accumulating the game result in the storage unit when the communication is impossible, and sending the accumulated game result to the server after the communication is restored.

With this arrangement, even if the communication with the server is impossible, the game information can be locally stored. Return to the normal state is therefore possible after the progress of the game in the offline state, with the result that loss due to discontinuation of the game is prevented.

The game controller of the present invention may be arranged such that the chip database includes a last update time, and the control unit downloads the chip database as the offline data from the server when, at the predetermined timing, the last update time of the chip database of the server is later than the last update time of the offline data.

According to this arrangement, because the last update dates and times are compared and the chip database of the server is downloaded only when its last update time and date is later than that of the offline data, a load on the network resource is restrained and a possibility of suppressing communication regarding security such as authentication of the game chips is lowered.

The game controller of the present invention may be arranged such that, the control unit determines whether the communication with the server is possible, when additional registration of a new game chip is requested, when the communication is possible, registering identification information for identifying the new game chip in the server, in association with information indicating that the identification information is valid, when the communication is impossible, storing the identification information for identifying the new game chip in the storage unit, in association with information indicating that the identification information is valid, and notifying the server that the accumulated identification information is valid, after the communication is restored.

According to this arrangement, even if the communication with the server is impossible, a new game chip is validated and the game chip is provided for a player as a usable game chip. In this way, scarcity of the game chips is restrained for players.

It is possible to continue the game without lowering the security, even in the offline state in which the network is down.

BRIEF DESCRIPTION OF THE DRAWINGS

FIG. 3 is an explanatory diagram a game information table.

FIG. 4 is an explanatory diagram a deal information table.

FIG. 8 is an explanatory diagram of an offline data table.

DETAILED DESCRIPTION OF THE PREFERRED EMBODIMENT (Outline)

A game controller of the present invention is communicably connected to a server which manages information used for authenticating game chips dedicated to a gaming facility, and the game controller is configured to download the management information in advance from the server at a predetermined timing. On this account, the game controller is able to refer to information used for authenticating game chips even when communication connection with the server is impossible, and is therefore able to authenticate the game chips used for a game.

Figure 1:
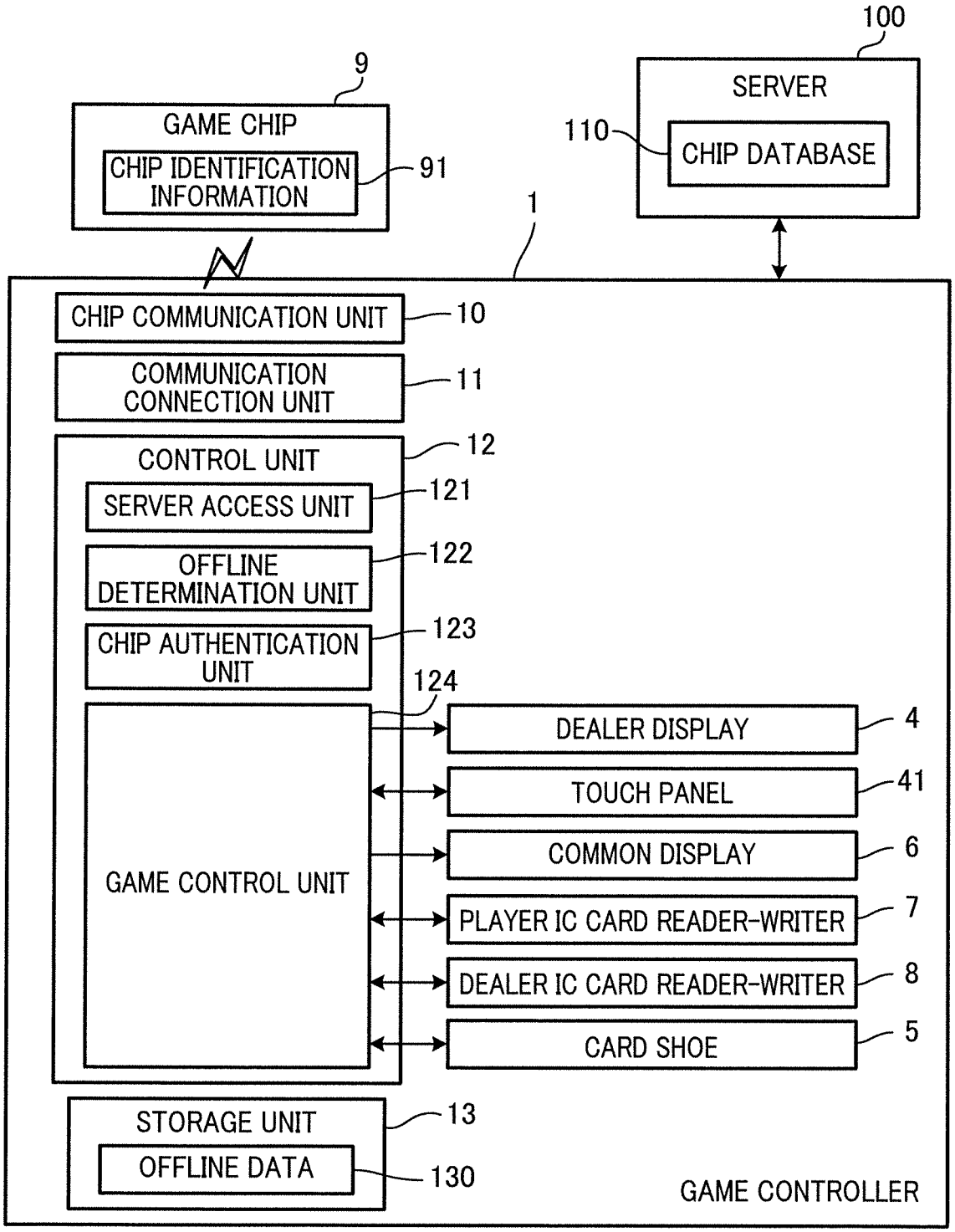
FIG. 1 is a schematic block diagram of a game controller.

To be more specific, as shown in FIG. 1, the game controller 1 of the present embodiment is connected to a server 100 so that data communications therebetween are possible. In other words, a game control system including the server 100 and at least one game controller 1 is constructed.

A game chip 9 has a storage area for storing information. In the storage area, at least chip identification information 91 by which a game chip used in the gaming facility is uniquely identified is stored. The server 100 includes a chip database 110 in which all sets of chip identification information 91 used in the gaming facility are associated with sets of the information used for authenticating the game chips 9. When connected to the server 100, the game controller 1 refers to the chip identification information 91 of the game chip 9 in the server 100 each time the game chip 9 is used, and receives an authentication result of the game chip 9 in response. The game chips 9 may not be cashed in. For example, the game chips may be used only for betting with which a game is played.

The "information used for authenticating a game chip" can be variously arranged on condition that the information indicates that the game chip can be used by users. For example, in the chip database 110, the chip identification information 91 is associated with "valid" or "invalid" as information used for authenticating the game chips 9. To put it differently, when a game chip 9 is issued, the game controller 1 or a predetermined apparatus requests the server 100 to validate the "information used for authenticating the game chip" associated with the chip identification information 91 of that game chip 9. Meanwhile, when a game chip 9 betted by a user is collected or when a game chip 9 is cashed in, the game controller 1 or a predetermined apparatus requests the server 100 to invalidate the "information used for authenticating the game chip" associated with the chip identification information 91 of that game chip 9. Hereinafter, the information used for authenticating game chips 9 may be referred to as chip authentication information.

(Game Controller 1)

The game controller 1 includes a chip communication unit 10 accessible to the game chips 9, a communication connection unit 11, a control unit 12, and a storage unit 13.

The chip communication unit 10 is accessible to the chip identification information 91 of the game chips 9 used in the game. For example, the chip communication unit 10 is formed of an antenna for reading information stored in the IC tag of a game chip 9 by wireless such as RFID, and a controller of the antenna. The communication connection unit 11 is an interface which enable data communication with the server 100.

The control unit 12 includes a server access unit 121, an offline determination unit 122, a chip authentication unit 123, and a game control unit 124. The server access unit 121 has a function of downloading the chip database 110 from the server 100 at a predetermined timing and storing the chip database 110 as offline data in the storage unit 13. The offline determination unit 122 is configured to determine whether the communication with the server 100 is impossible (offline), when the chip communication unit 10 accesses a game chip 9. The chip authentication unit 123 is configured to authenticate the game chip 9 with reference to the offline data in the storage unit 13, when the communication with the server 100 is impossible.

When the communication with the server 100 is impossible in this manner, authentication of the game chip 9 is performed with reference to offline data which is the same information as the chip database 110 and has been downloaded from the server 100 in advance. This makes it possible to continue the game without lowering the security, even in the offline state in which the network is down.

In the present embodiment, the "predetermined timing" at which the control unit 12 downloads the chip database 110 is a timing at which the game controller 1 is activated and is predetermined intervals. The disclosure, however, is not limited to this arrangement. The method of determining whether the network is offline is not limited to a particular method. For example, the game controller 1 may determine that the network is offline when there is no response from the server 100 for a predetermined time from a request such as authentication.

The game control unit 124 of the control unit 12 has a function as a deal information acquisition unit capable of acquiring deal information of game chips between a player playing the game and a dealer managing the game and a function as a game result acquisition unit capable of acquiring game results.

The game controller 1 includes the following members which are not illustrated: a CPU (Central Processing Unit); an EEPROM (Electrically Erasable and Programmable Read Only Memory) rewritably storing programs executed by the CPU and data used for the programs; and a RAM (Random Access Memory) temporarily storing data when a program is executed. A hard disk device may be additionally included according to need. The above-described functional units 10 to 13 of the game controller 1 are constructed by cooperation between these sets of hardware and software in the EEPROM. The game controller 1 may not be a single apparatus, and functions of the game controller 1 may be distributed to plural apparatuses. Furthermore, while the present embodiment mainly deals with the game controller which is a device for playing a game, the above-described functions and below-described arrangements may be applied to a device of another type. For example, the functions and arrangements may be applied to a gaming facility device such as a cashing machine and a money changer machine, which is provided at a counter in the gaming facility or the like and converts the game chips 9 to gaming values (e.g., currencies, game points, or game chips 9 of another type).

Figure 2:
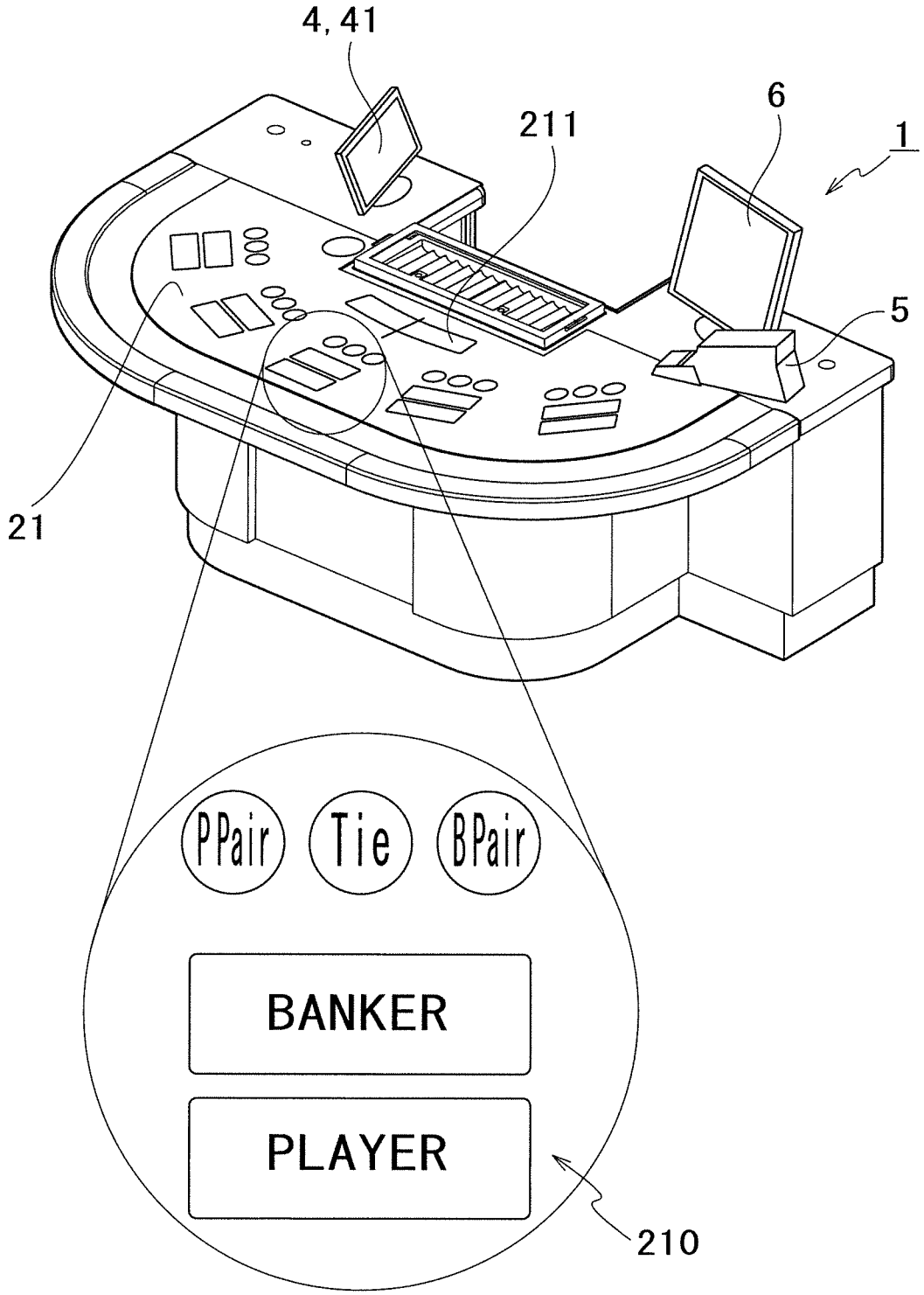
FIG. 2 is a perspective view of the game controller.

As shown in FIG. 2, the game controller 1 of the present embodiment is a gaming table for baccarat which is a game run by a dealer. On a game board 21 constituting the top surface of the game controller 1, a betting area 210 of each player and a dealer area 211 are provided. In the betting area 210, an area where a game chip 9 is betted for each bet object is provided. The game controller 1 has antennas provided at the game board 21 to correspond to the bet objects in the betting area 210 and the dealer area 211, respectively. This allows the game controller 1 to read a game chip 9 for each bet object in the betting area 210 and a game chip 9 in the dealer area 211. The game may be poker or roulette, for example, and the game may be automatically run.

As shown in FIG. 1 and FIG. 2, the game controller 1 includes members such as: a dealer display 4 which includes a touch panel 41 and assists the dealer to run the game and exchange the game chips 9 with users; a card shoe 5 which supplies cards and scans the supplied cards to output the game progress and game results to the game control unit 124; and a common display 6 which displays the state of the game and a game result history for the users. The progress of the game is divided, for example, into a bet phase, a bet monitoring phase, a collection phase, and a payment phase. The game controller 1 is able to grasp what is the current phase base on game information acquired by the card shoe 5 and a dealer's touch onto the dealer display 4. The game controller 1 is able to scan the betting area 210 and the dealer area 211 in each phase and to identify a game chip 9 betted by each player, a game chip 9 collected by the dealer, and a game chip 9 awarded to a player by the dealer. In this way, in the present embodiment, due to the function of the game control unit 124, the game controller 1 is able to acquire the game information indicating game results or the like and the deal information indicating the exchange of the game chips 9 with the users. The disclosure, however, is not limited to this arrangement. The game information and the arrangement and method of acquiring the deal information may be identical with those disclosed in U.S. Unexamined Patent Publication No. 2017-0018140A1.

As shown in FIG. 1, the game controller 1 includes player IC card reader-writers 7 controlled by the game control unit 124 and a dealer IC card reader-writer 8. The player IC card reader-writers 7 are provided to correspond to the respective betting areas 210 of the game board 21. The player IC card reader-writer 7 writes and reads data to and from a player's ID card inserted into a card slot (not illustrated). The card slot is provided in the vicinity of each betting area 210. The player's ID card stores player identification information by which the player is identified. The dealer IC card reader-writer 8 is provided at a card slot (not illustrated) which is on the side where the dealer display 4 and the common display 6 are provided in the game controller 1. The dealer IC card reader-writer 8 writes and reads data to and from a dealer's ID card inserted into the card slot. The dealer's ID card stores dealer identification information by which the dealer is identified. The player identification information and the dealer identification information read by the player IC card reader-writers 7 and the dealer IC card reader-writer 8 are associated with the game controller 1 or the game run by the game controller 1.

The game controller 1 is arranged to store, in the storage unit 13, game information indicating a game result or the like and history of deal information, and to send the sets of information to the server 100 one after another. To put it differently, the game controller 1 acquires the game information indicating a game result or the like and the deal information and determines if the game controller 1 is in the offline state in which the connection with the server 100 is impossible. When the game controller 1 is not in the offline state, the game controller 1 sends the acquired game information or deal information to the server 100 one after another (not illustrated). Furthermore, the game controller 1 accumulates the game information and deal information in the storage unit 13 each time it acquires information, and if there are the game information and the deal information accumulated during a period in which the game controller 1 is in the offline state, the game controller 1 sends these sets of information to the server 100 after the restoration of the communication (see later-described FIG. 10). The following specifically describes an example of the game information and the deal information stored in the storage unit 13 by the game controller 1.

(Game Controller 1: Game Information Table)

A game information table storing game information will be described with reference to FIG. 3. As shown in FIG. 3, the game information table has a table ID column, a dealer ID column, a game ID column, a game result ID column, a participant ID column, a seat ID column, a bet object ID column, a bet amount ID column, a payout ID column, a commission column, and a server column. In addition to them, a history of cards picked until a game result is fixed may be stored as game information.

In the table ID column, a table ID which is identification information uniquely identifying the game controller 1 is stored. The table ID is assigned to each game controller 1 in advance. For example, the table ID may be a MAC address of the communication connection unit 11, if it is associated in an identifiable manner.

In the dealer ID column, dealer identification information of the dealer who manages the game at the game controller 1 is stored. Before managing the game at the game controller 1, the dealer causes the dealer IC card reader-writer 8 to read the dealer's ID card. In other words, the game controller 1 stores, in the dealer ID column, the dealer identification information of the ID card read by the dealer IC card reader-writer 8.

In the game ID column, a game ID of each execution of the game is stored. In other words, the game ID makes it possible to identify how many times the game has been run in the game controller 1. In the game result ID column, a game result is stored. In the present embodiment, the game is baccarat and a game result is one of PLAYER, BANKER, TIE, PLAYER PAIR, and BANKER PAIR.

In the participant ID column, player identification information of a participant of the game is stored. Before participating in the game at the game controller 1, a player causes the player IC card reader-writer 7 to read his/her ID card. In other words, the game controller 1 stores, in the participant ID column, the player identification information of the ID card read by the dealer IC card reader-writer 7. In the seat ID column, a seat ID which is identification information uniquely identifying each betting area 210 in the game controller 1 is stored. This makes it possible to identify which betting area 210 is used by a player to participate in the game.

In the bet object column, information is stored to indicate which bet object in the betting area 210 a participant has placed a bet. In the present embodiment, one of PLAYER, BANKER, TIE, PLAYER PAIR, and BANKER PAIR is stored in the bet object column. In the bet amount column, an amount of betting on each bet object by a player is stored. In the payout column, a payout amount corresponding to a game result, a bet object, and a bet amount is stored. In the commission column, a house edge amount is stored. When a participant bets on BANKER and wins, 5% of the payout amount is collected as house edge.

In the server column, information indicating whether the game information has been sent to the server 100 is stored. The game controller 1 sends the game information to the server 100 each time the game is run. When the sending of the game information to the server 100 is properly completed, the game controller 1 stores TRUE in the server column of the data having been sent. When the sending of the game information to the server 100 is not properly completed, the game controller 1 stores FALSE in the server column of the data having been sent. Alternatively, when the sending of the game information to the server 100 is not properly completed, the data may be stored in a different data table for storage until the communication with the server 100 is restored.

(Game Controller 1: Deal Information Table)

A deal information table storing deal information will be described with reference to FIG. 4. As shown in FIG. 4, the deal information table has a table ID column, a dealer ID column, a game ID column, a participant ID column, a chip ID column, a chip amount column, an owner before game column, an owner after game column, and a server column. The table ID column, the dealer ID column, the game ID column, and the participant ID column are identical with those of the game information table and are not explained. In addition, history indicating in which betting area 210 the game chip 9 is placed may be stored.

The chip ID column stores chip identification information 91 by which a game chip 9 is identified. The chip amount column stores an amount of gaming values indicated by a game chip 9. In the owner before game column, an owner before the start of the game is stored. The game controller 1 may obtain the owner before the game from the server 100 at the time of authentication of the game chip 9, or may obtain the information from the game chip 9 when it is stored in the game chip 9. The game controller 1 may obtain the information from offline data when the apparatus is in the offline state. In the owner after game column, an owner after a game result of the game is output is stored. The game controller 1 may determine the owner after the game based on the game result, or may determine the owner based on an input to the touch panel 41 of the dealer display 4 by the dealer.

In the server column, information indicating whether the game information has been sent to the server 100 is stored, in the same manner as in the game information table. The game controller 1 sends the deal information to the server 100 each time the game is run. When the sending of the deal information to the server 100 is properly completed, the game controller 1 stores TRUE in the server column of the data having been sent. When the sending of the deal information to the server 100 is not properly completed, the game controller 1 stores FALSE in the server column of the data having been sent. Alternatively, when the sending of the deal information to the server 100 is not properly completed, the data may be stored in a different data table for storage until the communication with the server 100 is restored.

(Game Chip 9)

The game chip 9 is formed of resin or the like and an RFID tag which is an IC chip for RFID is provided in a central part of the game chip (not illustrated). The types of the game chips 9 include medals, tokens, and plaques. Each game chip 9 indicates currency information or a gaming value of a game point in the form of appearance. The appearance indicates information recognizable from the outside, such as color, pattern, text, image, and shape.

As described above, the RFID tag of the game chip 9 stores the chip identification information. In addition to this, the RFID tag may store the following sets of electronic information. For example, the electronic game chip 9 may store electronic information such as a gaming value of the game chip 9, a money type, an issuer, an issue date, and an expiration date. The money type is information indicating to which currency unit the gaming medium belongs. The issuer is information indicating the issuer of the game chip 9. The issuer may be information for identifying an entity which hands over the game chips 9 to participants. For example, when a gaming facility such as a casino directly issues game chips 9 for users, the issuer is the gaming facility. When the game chips 9 issued by a gaming facility are handed over to participants via a junket, the issuer is information for identifying the junket.

(Server 100)

The server 100 is a computer and includes the following members which are not illustrated: a CPU (Central Processing Unit); an EEPROM (Electrically Erasable and Programmable Read Only Memory) rewritably storing programs executed by the CPU and data used for the programs; and a RAM (Random Access Memory) temporarily storing data when a program is executed. A hard disk device may be additionally included according to need. A control unit of the above-described functions of the server 100 is constructed by cooperation between these sets of hardware and software in the EEPROM. The server 100 may not be a single apparatus, and functions of the server 100 may be distributed to plural apparatuses.

The server 100 is constructed to return a response based on stored data in response to requests from the game controllers 1 which are connected to the server 100 via a communication line. For example, in response to a request for authentication along with chip identification information 91 of a game chip 9 from a game controller 1 or a predetermined device, the server 100 refers to chip authentication information associated with the chip identification information 91 in the chip database 110, and returns the authentication result.

Figure 5:
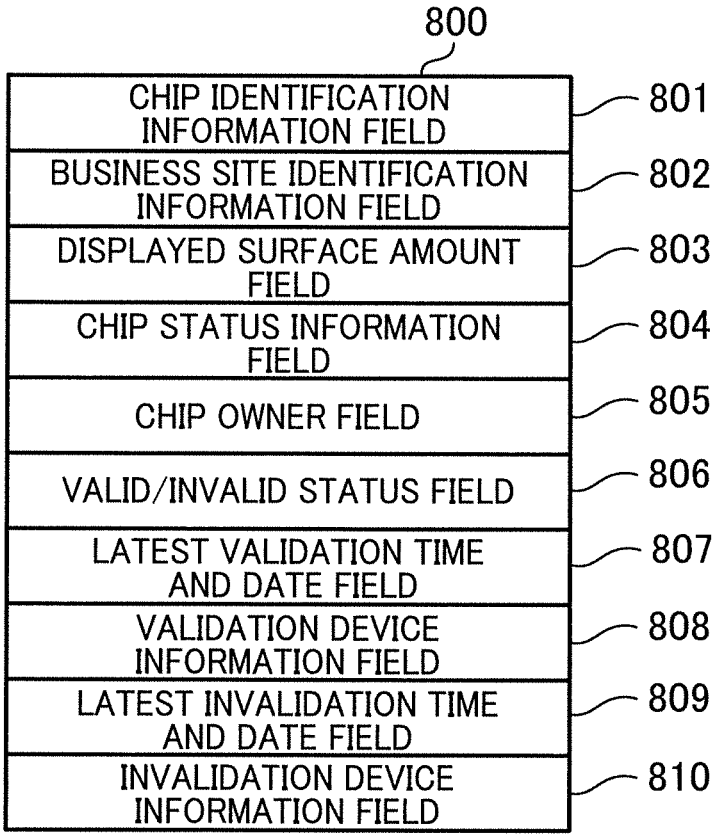
FIG. 5 is an explanatory diagram of the record structure of a chip database.

To be more specific, the following shows an example of the data structure of a record 800 stored in the chip database 110 with reference to FIG. 5. The record 800 includes a chip identification information field 801, a business site identification information field 802, a displayed surface amount field 803, a chip status information field 804, a chip owner field 805, a valid/invalid status field 806, a latest validation time and date field 807, a validation device information field 808, a latest invalidation time and date field 809, and an invalidation device information field 810. Although not illustrated, a time stamp is associated with the record 800 itself. The latest time and date when any one of the fields is updated is registered as the time stamp. In other words, the record 800 is associated with a time stamp indicating the last update time and date when the current record 800 is formed. The game controller 1 downloads the time stamp together with the record 800.

In the chip identification information field 801, chip identification information 91 stored in the RFID IC tag of the game chip 9 used in the gaming facility is stored. In the record 800, the chip identification information 91 of the game chip 9 functions as a unique key. In the business site identification information field 802, information for specifying the gaming facility, hotel, etc. where the game chip 9 is used is stored. In the displayed surface amount field 803, a displayed value or a point of the game chip 9 is stored. For example, "10" is stored when the monetary value of the game chip 9 is $10, or "100" is stored when the monetary value is $100.

In the chip status information field 804, information indicating the state of the game chip 9 in terms of accounting is stored. Examples of the information stored in the chip status information field 804 include information indicating that the chip has been handed over to a player in exchange for cash, information indicating that the chip is awarded to a player as a payout, information indicating that the chip has been collected from a player, and information indicating that the chip has been cashed in. In the chip owner field 805, information indicating the owner of the game chip 9, e.g., player identification information is stored.

In the valid/invalid status field 806, valid/invalid information indicating whether the game chip 9 is valid or invalid is stored. The valid/invalid information is information indicating that the game chip 9 is valid or invalid. In other words, the value of the valid/invalid status field 806 associated with the chip identification information 91 functions as the chip authentication information. In response to a request for authentication along with chip identification information 91 of a game chip 9 from a game controller 1 or a predetermined device, the server 100 refers to the value of the valid/invalid status field 806 associated with the chip identification information 91 in the chip database 110, and authenticates the game chip 9 as the game chip is usable by players if the value is valid, or does not authenticate the game chip 9 as the game chip is not usable by players if the value is invalid. The server 100 does not authenticate the game chip 9 as the game chip is not usable by players when the chip identification information 91 accompanied with the authentication request is not found in the chip database 110.

In the present embodiment, all game chips 9 used in the gaming facility are validated or invalidated. For example, a validated game chip 9 has a monetary value in the gaming facility, and is allowed to be changed to cash at a casher or to be used for payment in place of cash in shops such as a restaurant. Meanwhile, an invalidated game chip 9 has no monetary value in the gaming facility and cannot be used in the gaming facility, etc.

The validation and invalidation of the game chips 9 are managed by the server 100. For example, when a game chip 9 is owned by the gaming facility as a result of, for example, a deal in the game, the game controller 1 or another predetermined device requests the server 100 to invalidate that game chip 9. In other words, a game chip 9 is invalidated when the game chip 9 is not lent to a player. Meanwhile, when the game chip 9 becomes owned by a user as a result of, for example, a deal in the game or purchase by the user, the game controller 1 or another predetermined device requests the server 100 to validate the game chip 9. In other words, a game chip 9 is validated when the game chip 9 is lent to a player. As such, when the game chips 9 are handed over between an employee of the gaming facility such as a dealer and a user, the employee of the gaming facility validates or invalidates the game chips 9 via the game controller 1 or another predetermined device. For this reason, even if a user deceivingly obtains a game chip 9, the game chip 9 cannot be used because an invalidated game chip 9 is not authorized.

In the latest validation time and date field 807, the latest time and date of the validation of a game chip 9 is stored. In the validation device information field 808, information specifying the device which read the RFID IC tag of a game chip 9 at the latest validation of the game chip is stored.

In the latest invalidation time and date field 809, the time and date of the latest invalidation of a game chip 9 is stored. In the invalidation device information field 810, information specifying the device which read the RFID IC tag of a game chip 9 at the latest invalidation of the game chip is stored.

(Operations)

Operations of the game controller 1 structured as described above, which are mainly executed by the control unit 12, will be explained with reference to a flowchart.

(Operation: Download Process)

Figure 6:
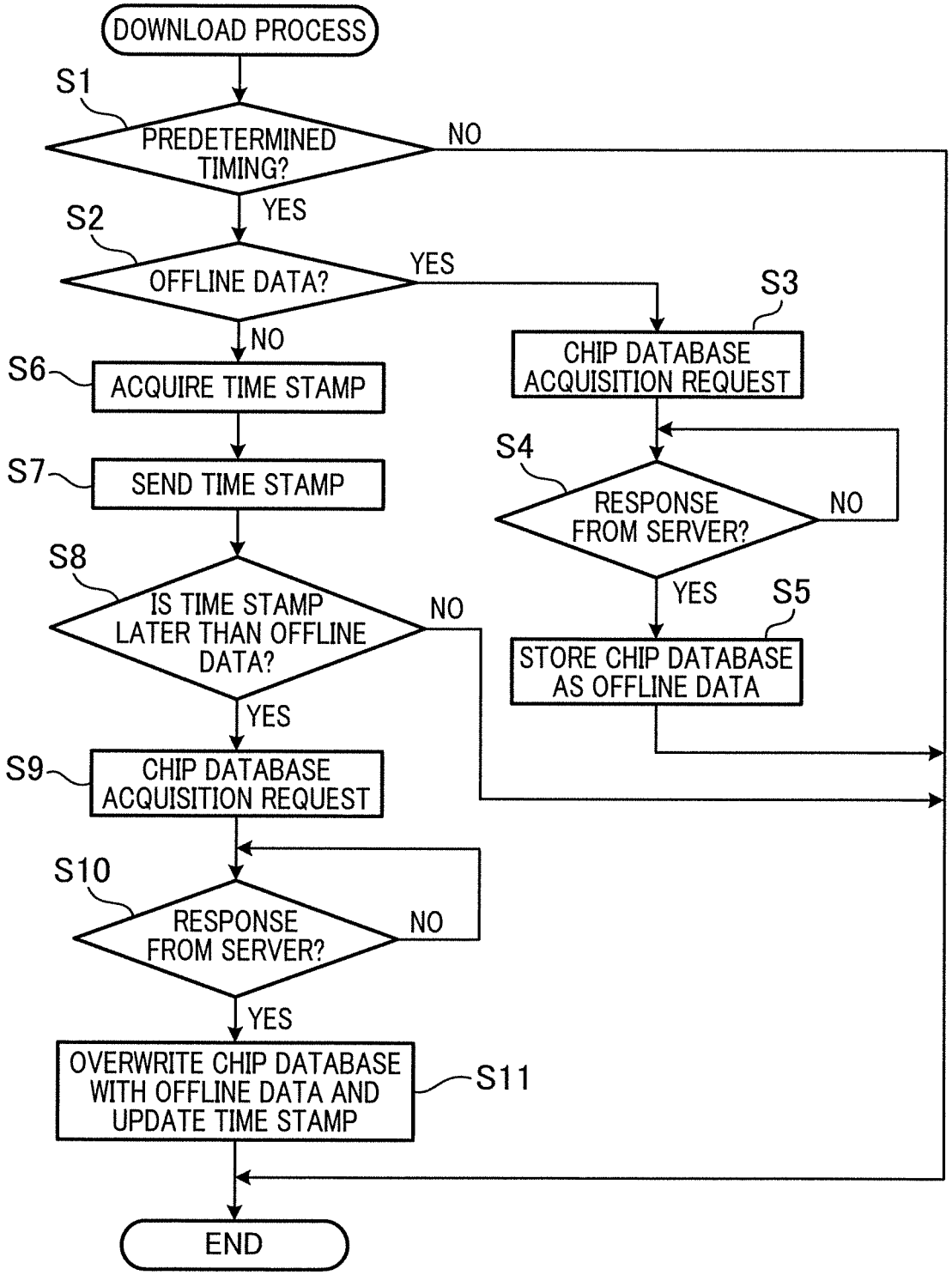
FIG. 6 is a flowchart of a download process.

A download process executed by the control unit 12 will be explained with reference to FIG. 6. To begin with, the control unit 12 determines whether the current time is a predetermined timing (S1). In the present embodiment, the predetermined timing is a timing of activation and a timing which comes everyday. When the current time is not the predetermined timing (S1: No), the control unit 12 ends the routine. Meanwhile, when the current time is the predetermined timing (S1: Yes), the control unit 12 refers to offline data in the storage unit 13 and determines whether the offline data exists (S2). When there is no offline data (S2: No), the control unit 12 sends a request for acquiring data of the chip database 110 to the server 100 (S3). Subsequently, the control unit 12 determines whether the data of the chip database 110 has been downloaded from the server 100 (S4). When the data of the chip database 110 has not been downloaded (S4: No), the control unit 12 repeats the step S4 until the download. Meanwhile, when the data of the chip database 110 has been downloaded (S4: Yes), the control unit 12 stores the data of the chip database 110 acquired as a response in the storage unit 13 as the offline data (S5) and ends the routine.

When there is offline data in the step S2, the control unit 12 acquires the time stamp of the offline data (S6). The control unit 12 then sends a database update time and date determination request including the time stamp to the server 100 (S7).

The server 100 has a function of, upon receiving the database update time and date determination request from the game controller 1, comparing the time stamp associated with the chip database 110 with the time stamp having been sent, and answering whether the time stamp associated with the chip database 110 is later than the time stamp having been sent. When the time stamp is sent from the game controller 1, the server 100 may send the data of the chip database 110 if the time stamp associated with the chip database 110 is later than the time stamp having been sent.

The control unit 12 then determines whether the time stamp of the chip database 110 is later than the time stamp of the offline data, based on the response from the server 100 (S8). When the time stamp is earlier than that of the offline data (S8: No), the control unit 12 ends the routine.

Meanwhile, when the time stamp is later than that of the offline data (S8: No), the control unit 12 sends a request for acquiring the data of the chip database 110 to the server 100 (S9). Subsequently, the control unit 12 determines whether the data of the chip database 110 has been sent from the server 100 (S10). When the data of the chip database 110 has not been sent (S10: No), the control unit 12 repeats the step S8 until the data is sent.

Meanwhile, when the data of the chip database 110 has been sent (S10: Yes), the control unit 12 overwrites the downloaded data of the chip database 110 onto the offline data of the storage unit 13 and updates the time stamp of the offline data by the time stamp of the downloaded data of the chip database 110 (S11), and then the control unit 12 ends the routine.

As such, the chip database includes the last update time, and the control unit 12 downloads the chip database 110 from the server 100 as the offline data, when, at the predetermined timing, the last update time of the chip database 110 in the server 100 is later than the last update time of the offline data. Because the time stamps are compared and the chip database 110 of the server 100 is downloaded only when its timestamp is later than that of the offline data, a load on the network resource is restrained and a possibility of suppressing communication regarding security such as authentication of the game chips 9 is lowered.

(Operation: Offline Data Update Process)

Figure 7:
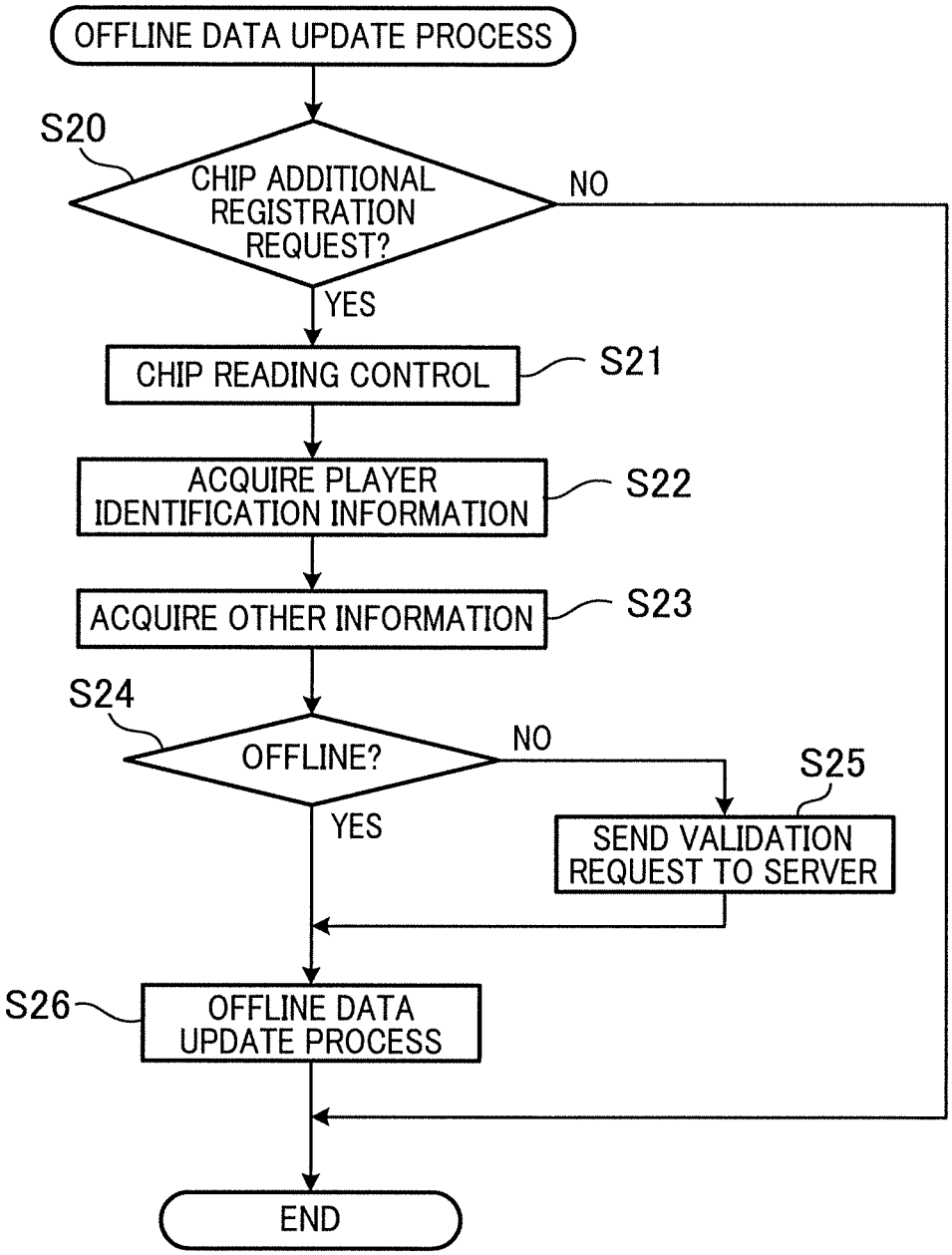
FIG. 7 is a flowchart of an offline data update process.

An offline data update process executed by the control unit 12 will be explained with reference to FIG. 7. To begin with, the control unit 12 determines whether a chip additional registration request has been made by an operation of the touch panel 41 or the like by the dealer (S20). When no chip additional registration request has been made (S20: No), the control unit 12 ends the routine.

Meanwhile, when the chip additional registration request has been made (S20: Yes), the control unit 12 controls the chip communication unit 10 to read the chip identification information 91 of all game chips 9 placed on an area (e.g., the dealer area 211) which is selected for chip additional registration in advance (S21). The control unit 12 then acquires player identification information from a player's IC card or the like (S22). Furthermore, the control unit 12 acquires other information registered to the server 100, from the storage unit 13, the game chip 9, or the like (S23). Examples of the other information registered to the server 100 include identification information of a gaming facility where the game controller 1 is installed, identification information of the game controller 1, a value of a game chip 9, and a chip state. The control unit 12 determines whether the communication connection with the server 100 is offline (S24). When the connection is not offline (S24: No), the control unit 12 sends, to the server 100, a request to validate game chips 9 indicated by the chip identification information 91 having been read, which includes data in which the chip identification information 91 having been read is associated with the acquired player identification information and the other information (S25).

After the step S25 or when the connection is offline in the step S24 (S24: No), the control unit 12 executes an offline data update process to validate the chip identification information 91, based on the data in which the chip identification information 91 having been read is associated with the acquired player identification information and the other information (S26), and ends the routine. As such, when performing additional registration of the game chips 9, the control unit 12 executes the process of registration to the server 100 and the process of updating the offline data, when the connection is online.

Referring to FIG. 8, an example of an offline data table which is stored as the offline data in the storage unit 13 is shown. Being similar to the record 800 of the chip database 110, the offline data table includes a chip identification information field, a business site identification information field, a displayed surface amount field, a chip status information field, a chip owner field, a valid/invalid status field, a latest validation time and date field, a validation device information field, a latest invalidation time and date field, and an invalidation device information field. In addition to them, the offline data table includes a server field.

In the offline data update process (see FIG. 7), the chip identification information 91 of all game chips 9 to be additionally registered is searched for in the offline data table, and the field corresponding to each set of data is updated. For example, when a betted game chip 9 is collected, the chip status information field of the data of the corresponding chip identification information 91 is updated to "collected", the chip owner field is updated to the identification information of the gaming facility, the valid/invalid status field is updated to "invalid", the latest invalidation time and date is updated, the invalidation device information field is updated to the identification information of the game controller 1, and the server field is updated to TRUE when the connection is online or updated to FALSE when the connection is offline.

Furthermore, for example, when a game chip 9 is cashed in, the chip status information field of the data of the corresponding chip identification information 91 is updated to "cash in", the chip owner field is updated to the identification information of the gaming facility, the valid/invalid status field is updated to "invalid", the latest invalidation time and date is updated, the invalidation device information field is updated to the identification information of the game controller 1, and the server field is updated to TRUE when the connection is online or updated to FALSE when the connection is offline.

Furthermore, for example, when a game chip 9 is purchased, the chip status information field of the data of the corresponding chip identification information 91 is updated to "purchased", the chip owner field is updated to the player identification information of the player who purchased the game chip, the valid/invalid status field is updated to "valid", the latest validation time and date is updated, the validation device information field is updated to the identification information of the game controller 1, and the server field is updated to TRUE when the connection is online or updated to FALSE when the connection is offline.

Furthermore, for example, when a game chip 9 is awarded as a payout, the chip status information field of the data of the corresponding chip identification information 91 is updated to "payout", the chip owner field is updated to the player identification information of the player who purchased the game chip, the valid/invalid status field is updated to "valid", the latest validation time and date is updated, the validation device information field is updated to the identification information of the game controller 1, and the server field is updated to TRUE when the connection is online or updated to FALSE when the connection is offline.

Although not illustrated, when the chip identification information 91 of a game chip 9 to be additionally registered is not found in the offline data table, a deceit may be reported to the server or the like.

(Operation: Chip Authentication Process)

Figure 9:
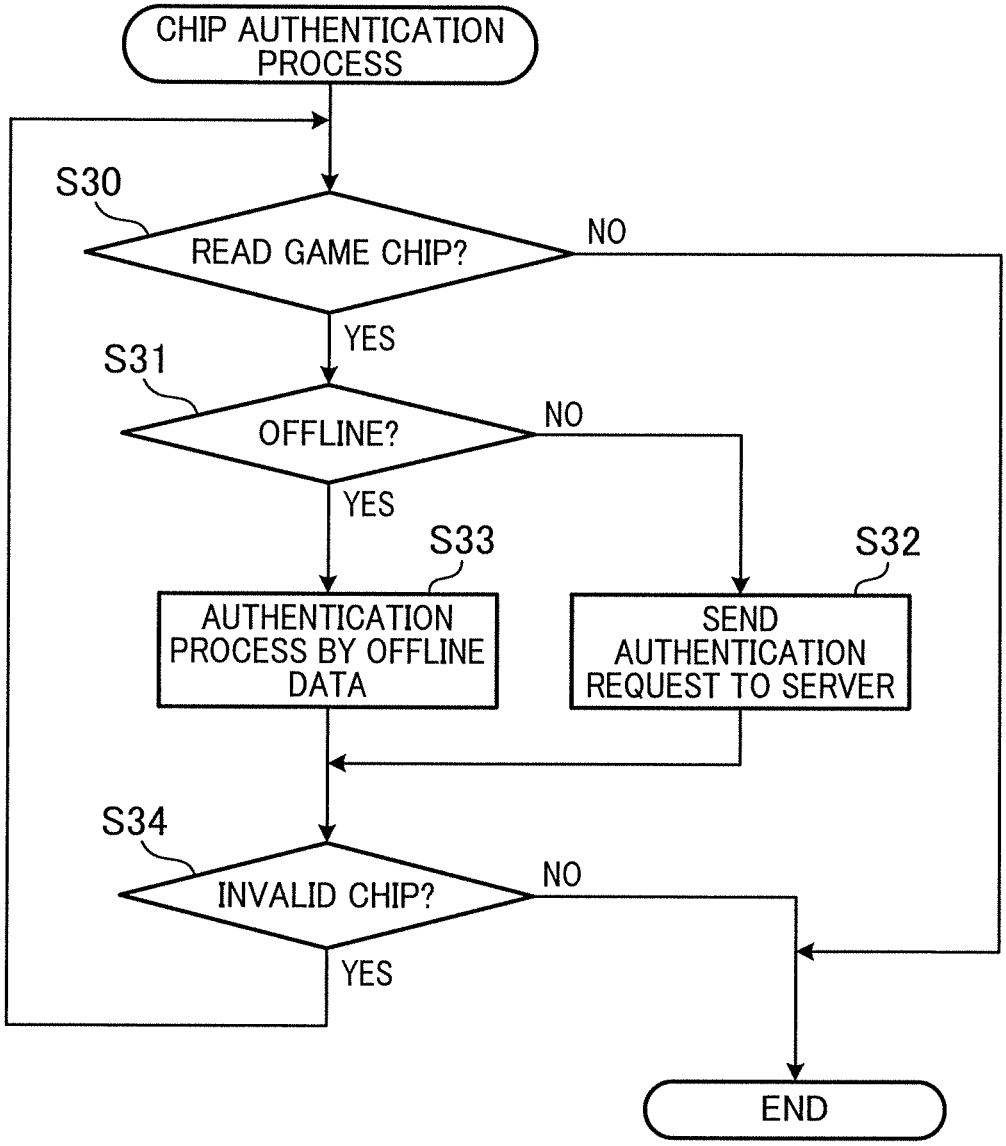
FIG. 9 is a flowchart of a chip authentication process.

A chip authentication process executed by the control unit 12 will be explained with reference to FIG. 9. To begin with, the control unit 12 determines whether a game chip 9 of a participant has been read in the game (S30). The reading of the game chip 9 occurs when, for example, a participant places a game chip 9 in the betting area 210 in the bet phase in the game. When no game chip 9 has been read (S30: No), the control unit 12 ends the routine.

Meanwhile, when there is a game chip 9 having been read (S30: Yes), the control unit 12 determines whether the connection is offline (S31). When the connection is not offline (S31: No), the control unit 12 sends, to the server 100, an authentication request to which the chip identification information 91 of all game chips 9 having been read is added (S32).

The server 100 authenticates all chip identification information 91 added to the authentication request, and returns an authentication result to the game controller 1 which has sent the authentication request. The server 100 sends the authentication result in which the chip identification information 91 of the game chip 9 is associated with "valid" or "invalid".

When the connection is offline in the step S31 (S31: Yes), the control unit 12 searches the offline data table (see FIG. 8) for the chip identification information 91 of all game chips 9 having been read, and associate "invalid" or "valid" with the chip identification information 91 with reference to the valid/invalid status field.

After the step S32 or after the step S33, the control unit 12 determines if there is an invalid game chip 9 in all game chips 9 having been read (S34). When all game chips 9 are valid (S34: No), the control unit 12 ends the routine. When an invalid game chip 9 is included (S34: Yes), the routine returns to the step S30.

Although not illustrated, when an invalid game chip 9 is included, a deceit may be reported to the dealer display 4 or the like.

(Operation: Restoration Process)

Figure 10:
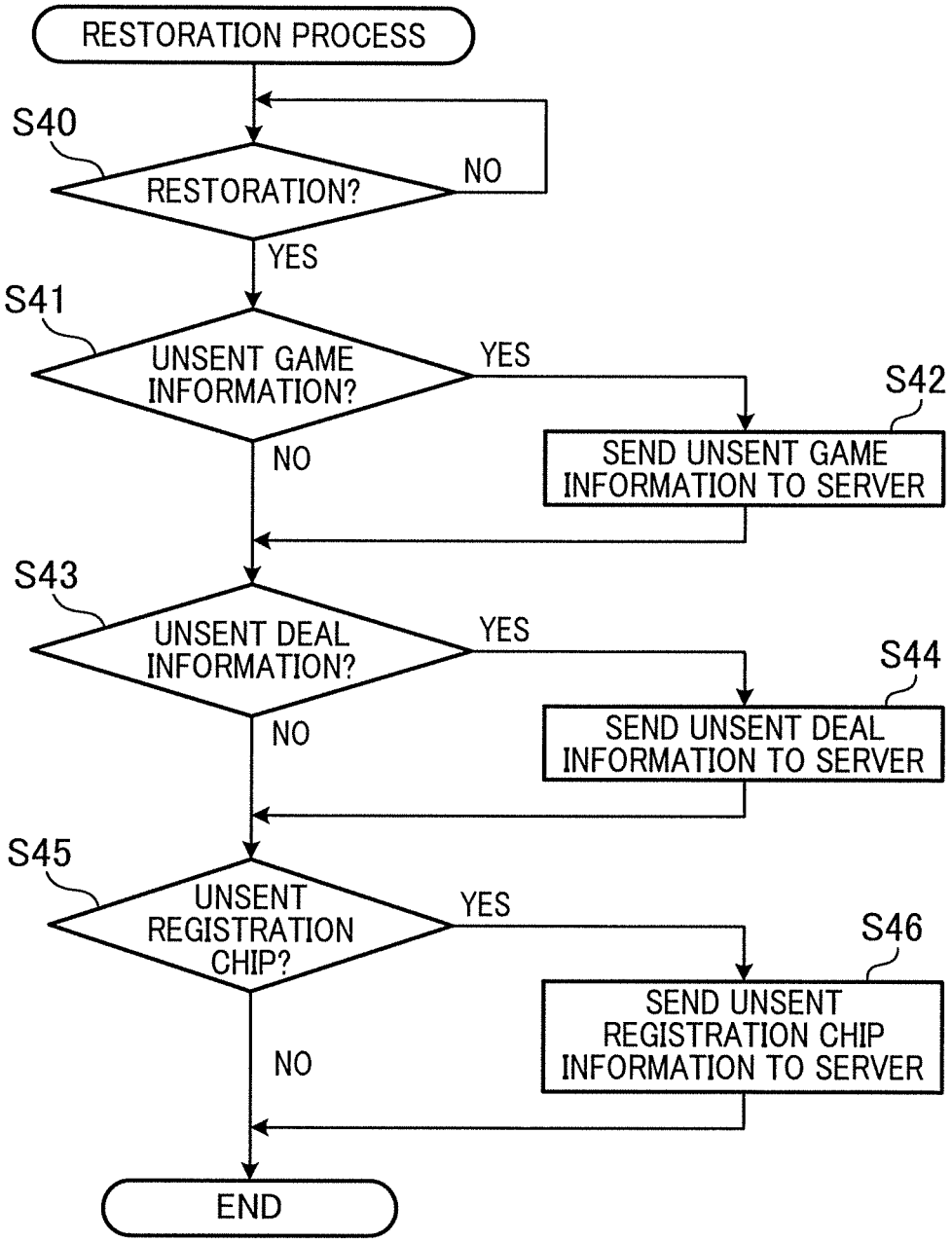
FIG. 10 is a flowchart of a restoration process.

A restoration process executed by the control unit 12 will be explained with reference to FIG. 10. To begin with, the control unit 12 determines whether restoration from the offline state to the online state has been done (S40). When the restoration has not been done (S40: No), the control unit 12 repeats the step S40 until the restoration is done. Meanwhile, when the restoration has been done (S40: Yes), the control unit 12 determines whether there is data having not been sent to the server 100, with reference to the game information table (see FIG. 3) (S41). When there is data having not been sent (S41: Yes), data which is "FALSE" in the server column is sampled from the game information table (see FIG. 3) and sent to the server 100 (S42).

When in the step S41 there is no data having not been sent (S41: No) or after the step S42, the control unit 12 determines whether there is data having not been sent to the server 100, with reference to the deal information table (see FIG. 4) (S43). When there is data having not been sent (S43: Yes), data which is "FALSE" in the server column is sampled from the deal information table (see FIG. 4) and sent to the server 100 (S44).

When in the step S43 there is no data having not been sent (S43: No) or after the step S44, the control unit 12 determines whether there is data having not been sent to the server 100, with reference to the offline data table (see FIG. 8) (S45). When there is data having not been sent (S45: Yes), data which is "FALSE" in the server column is sampled from the offline data table (see FIG. 8) and sent to the server 100 (S46). When in the step S45 there is no data having not been sent (S45: No) or after the step S46, the control unit 12 ends the routine.

As such, the game controller 1 includes the game control unit 124, the chip communication unit 10, etc. which function as a deal information acquisition unit capable of acquiring deal information of game chips 9 between a player playing the game and a dealer managing the game. The game controller 1 determines whether communication with the server 100 is possible when deal information is acquired. When the communication is possible, the game controller 1 sends the deal information to the server 100, and when the communication is impossible, the game controller 1 accumulates the deal information in the deal information table (see FIG. 4) of the storage unit 13. After the restoration of the communication, the game controller 1 sends the accumulated deal information to the server 100. With this arrangement, even if the communication with the server 100 is impossible, the deal information can be locally stored. Return to the normal state is therefore possible after the progress of the game in the offline state, with the result that loss due to discontinuation of the game is prevented.

In addition to the above, the game controller 1 further includes the game control unit 124, the chip communication unit 10, the card shoe 5, etc. which function as a game result acquisition unit capable of acquiring a game result of the game. The game controller 1 determines whether communication with the server 100 is possible when a game result is acquired. When the communication is possible, the game controller 1 sends the game result to the server 100, and when the communication is impossible, the game controller 1 accumulates the game result in the game information table (see FIG. 3) of the storage unit 13. After the restoration of the communication, the game controller 1 sends the accumulated game result to the server 100. With this arrangement, even if the communication with the server 100 is impossible, the game information can be locally stored. Return to the normal state is therefore possible after the progress of the game in the offline state, with the result that loss due to discontinuation of the game is prevented.

In addition to the above, when additional registration of a game chip 9 is newly requested, the game controller 1 determines whether communication with the server 100 is possible. If the communication is possible, the game controller 1 associates information "valid" with the chip identification information 91 of that game chip 9 and registers the information to the server 100. When the communication is impossible, the game controller 1 associates information "valid" with the chip identification information 91 of that game chip 9 and accumulates the information in the offline data table (see FIG. 8) of the storage unit 13. After the restoration of the communication, the game controller 1 registers, to the server 100, that the accumulated chip identification information 91 is valid. As such, even if the communication with the server 100 is impossible, a new game chip 9 is validated and the game chip 9 is provided for a player as a usable game chip. In this way, scarcity of the game chips 9 is restrained for players.

(Overview of Invention)

A game controller 1 includes: a chip communication unit 10 capable of accessing identification information of a game chip 9 used for a game; a communication connection unit 11 configured to enable data communication with a server 100 including a chip database 110 in which the chip identification information 91 for identifying the game chip 9 is associated with information used for authenticating the game chip 9; a storage unit 13; and a control unit 12, the control unit 12 downloading the chip database 110 from the server 100 at a predetermined timing and storing the chip database 110 as offline data in the storage unit 13, determining whether the communication with the server 100 is possible, when the chip communication unit 10 accesses the game chip 9, and authenticating the game chip 9 with reference to an offline data table (see FIG. 8) when the communication is impossible.

According to this arrangement, when the communication with the server 100 is impossible in this manner, authentication of the game chip 9 is performed with reference to the offline data table (see FIG. 8) which includes the same information as the chip database 110 and has been downloaded from the server 100 in advance. This makes it possible to continue the game without lowering the security, even in the offline state in which the network is down.

The game controller 1 further includes a game control unit 124, a chip communication unit 10, etc. which function as a deal information acquisition unit capable of acquiring deal information of game chips 9 between a player playing the game and a dealer managing the game. The control unit 12 determines whether communication with the server 100 is possible when deal information is acquired by the game control unit 124, the chip communication unit 10, etc. When the communication is possible, the game controller 1 sends the deal information to the server 100, and when the communication is impossible, the game controller 1 accumulates the deal information in the storage unit 13. After the restoration of the communication, the game controller 1 sends the accumulated deal information to the server 100.

According to this arrangement, even if the communication with the server 100 is impossible, the deal information can be locally stored. Return to the normal state after the restoration is therefore possible after the progress of the game in the offline state, with the result that loss due to discontinuation of the game is prevented.

In addition to the above, the game controller 1 further includes a game control unit 124, a chip communication unit 10, a card shoe 5, etc. which function as a game result acquisition unit capable of acquiring a game result of the game. The control unit 12 determines whether communication with the server is possible when a game result is acquired by the game control unit 124, the chip communication unit 10, the card shoe 5, etc. When the communication is possible, the game controller 1 sends the game result to the server, and when the communication is impossible, the game controller 1 accumulates the game result in the storage unit 13. After the restoration of the communication, the game controller 1 sends the accumulated game result to the server 100.

With this arrangement, even if the communication with the server 100 is impossible, the game information can be locally stored. Return to the normal state is therefore possible after the progress of the game in the offline state, with the result that loss due to discontinuation of the game is prevented.

The chip database 110 includes the last update time, and the control unit 12 downloads the chip database 110 from the server 100 as the offline data, when, at the predetermined timing, the last update time of the chip database 110 in the server 100 is later than the last update time of the offline data table.

According to this arrangement, because the last update dates and times are compared and the chip database 110 of the server 100 is downloaded only when its last update time and date is later than that of the offline data, a load on the network resource is restrained and a possibility of suppressing communication regarding security such as authentication of the game chips 9 is lowered.

In addition to the above, when additional registration of a game chip 9 is newly requested, the control unit 12 determines whether communication with the server 100 is possible. If the communication is possible, the game controller 1 associates information "valid" with the chip identification information 91 of that game chip and registers the information to the server 100. When the communication is impossible, the game controller 1 associates information "valid" with the chip identification information 91 of that game chip 9 and accumulates the information in the storage unit 13. After the restoration of the communication, the game controller 1 registers, to the server 100, that the accumulated chip identification information 91 is valid.

According to this arrangement, even if the communication with the server 100 is impossible, a new game chip 9 is validated and the game chip 9 is provided for a player as a usable game chip. In this way, scarcity of the game chips 9 is restrained for players.

The above embodiment thus described solely serves as a specific example of the present invention, and the present invention is not limited to such an example. Specific structures and various means may be suitably designed or modified. Further, the effects described in the embodiment of the present invention described in the above embodiment are no more than examples of preferable effects brought about by the present invention, and the effects of the present invention are not limited to those described hereinabove.

Further, the detailed description above is mainly focused on characteristics of the present invention to for the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the present invention described in this specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A game controller comprising:

a chip communication unit capable of accessing identification information for identifying a game chip used for a game, the identification information being located on the game chip;

a communication connection unit configured to enable data communication with a server including a chip database in which the identification information for identifying the game chip is associated with information used for authenticating the game chip;

a storage unit; and a control unit, the control unit downloading the chip database from the server at a predetermined timing and storing the chip database in the storage unit as offline data, determining whether data communication with the server is possible when the chip communication unit accesses the game chip, authenticating the game chip with reference to the chip database on the server when data communication with the server is possible, and authenticating the game chip with reference to the offline data stored in the storage unit when data communication with the server is impossible.

2. The game controller according to claim 1, further comprising a deal information acquisition unit capable of acquiring deal information of the game chip between a player who plays the game and a dealer who manages the game, the control unit determining whether data communication with the server is possible when the deal information acquisition unit acquires the deal information, sending the deal information to the server when data communication with the server is possible, accumulating the deal information in the storage unit when data communication with the server is impossible, and sending accumulated deal information to the server after data communication with the server is restored.

3. The game controller according to claim 1, further comprising a game result acquisition unit capable of acquiring game result information of the game, the control unit determining whether data communication with the server is possible when the game result acquisition unit acquires the game result information, sending the game result information to the server when data communication with the server is possible, accumulating the game result information in the storage unit when data communication with the server is impossible, and sending accumulated game result information to the server after data communication with the server is restored.

4. The game controller according to claim 1, wherein the chip database includes a last update time, and the control unit downloads the chip database from the server and stores the chip database in the storage unit as the offline data when, at the predetermined timing, the last update time of the chip database of the server is later than the last update time of the offline data.

5. The game controller according to claim 1, wherein the control unit determines whether data communication with the server is possible when additional registration of a new game chip is requested, when data communication with the server is possible, registers identification information for identifying the new game chip in the server in association with information indicating that the identification information is valid, when data communication with the server is impossible, stores the identification information for identifying the new game chip in the storage unit in association with information indicating that the identification information is valid, and notifies the server that accumulated identification information is valid after data communication with the server is restored.

* * * * *